US009245698B2

(12) United States Patent
Nakase et al.

(10) Patent No.: US 9,245,698 B2
(45) Date of Patent: Jan. 26, 2016

(54) MULTI DIRECTION SWITCH

(71) Applicant: HON HAI PRECISION INDUSTRY CO., LTD., New Taipei (TW)

(72) Inventors: Yusho Nakase, Yokohama (JP); Jian-Jin Lu, Shenzhen (CN); Liang Sun, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 149 days.

(21) Appl. No.: 13/974,050

(22) Filed: Aug. 23, 2013

(65) Prior Publication Data

US 2014/0054153 A1 Feb. 27, 2014

(30) Foreign Application Priority Data

Aug. 23, 2012 (CN) ..... 2012 1 0302206

(51) Int. Cl.

| | |
|---|---|
| ***H01H 3/38*** | (2006.01) |
| ***H01H 1/40*** | (2006.01) |
| ***H01H 25/04*** | (2006.01) |
| *H01H 1/36* | (2006.01) |

(52) U.S. Cl.

CPC ..... *H01H 3/38* (2013.01); *H01H 1/403* (2013.01); *H01H 25/04* (2013.01); *H01H 1/365* (2013.01); *H01H 2223/002* (2013.01)

(58) Field of Classification Search

CPC ..... H01H 3/38; H01H 25/04
USPC ..... 200/5 R
See application file for complete search history.

(56) References Cited

U.S. PATENT DOCUMENTS

| | | | | |
|---|---|---|---|---|
| 7,310,083 | B2 | 12/2007 | Hagiwara et al. | |
| 7,439,461 | B2 | 10/2008 | Sawada et al. | |
| 7,459,646 | B1 | 12/2008 | Shi | |
| 2009/0309829 | A1 * | 12/2009 | Tan | 345/156 |

FOREIGN PATENT DOCUMENTS

| | | | |
|---|---|---|---|
| CN | 101009169 | | 8/2007 |
| JP | 2006-107336 | | 4/2006 |
| JP | 3814279 | | 6/2006 |
| JP | 3814280 | | 6/2006 |
| JP | 2006-196473 | | 7/2006 |
| JP | 2007200707 | A * | 8/2007 |
| JP | 2011-233435 | | 11/2011 |

* cited by examiner

*Primary Examiner* — Edwin A. Leon
*Assistant Examiner* — Iman Malakooti
(74) *Attorney, Agent, or Firm* — Wei Te Chung; Ming Chieh Chang

(57) ABSTRACT

A multi direction switch (100) includes a first cover (2), a second cover (3), a printed circuit board (PCB) (4) positioned between the first cover and the second cover, a pair of stacked, orthogonal electrode plates (5) positioned between the second cover and the PCB, a spring member (7) positioned between the first cover and the PCB, and a button (6) for actuating the electrode plates to move on the PCB. The second cover forms a protrusion (21), the button has a radial portion (611) and a wall portion (612) extending downwardly from the radial portion, and the spring member is positioned between the protrusion and the wall portion.

1 Claim, 6 Drawing Sheets

MULTI DIRECTION SWITCH

BACKGROUND OF THE INVENTION

1. Field of the Invention

The present invention relates generally to a multi direction switch capable of outputting different signals denoting multi positions, and more particularly to a multi direction switch which includes a specially designed and positioned spring member.

2. Description of Related Arts

A multi direction switch is widely used in an electronic appliance for denoting multi positions when the electronic appliance is in use. Japanese Patent Pub. No. 2011-233435 discloses a conventional multi direction switch. The multi direction switch has a button for actuating two electrode plates thereof and a helical spring member for returning the button to its initial position. The multi direction switch is divided into two stacked upper and lower cavities by forming a block portion between a top cover and a bottom cover. The resilient spring member is positioned in the upper cavity above the block portion. The two electrode plates are positioned in the lower cavity below the block portion. The button comprises an operation portion extending out of the top cover, a widened radial portion in the upper cavity, and a narrowed actuating portion in the lower cavity. Therefore, the two electrode plates are actuated by the actuating portion to move on a printed circuit board along different directions for generating different signals. The radial portion extends inside the spring member for deflecting the spring member. Both the top cover and the block portion have ribs for confining the spring member. A gap is defined between the top cover rib and the block portion rib so that the widened radial portion can extend into and interact with the spring member.

An improved multi direction switch having a simple structure is desired.

SUMMARY OF THE INVENTION

Accordingly, an object of the present invention is to provide a multi direction switch having a simple structure.

To achieve the above object, a multi direction switch includes a first cover, and a second cover, a printed circuit board (PCB) positioned between the first cover and the second cover, a pair of stacked, orthogonal electrode plates positioned between the second cover and the PCB, a spring member positioned between the first cover and the PCB, and a button actuating the electrode plates to move on the PCB. The second cover forms a protrusion, the button has a radial portion and a wall portion extending downwardly from the radial portion, and the spring member is positioned between the protrusion and the wall portion.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
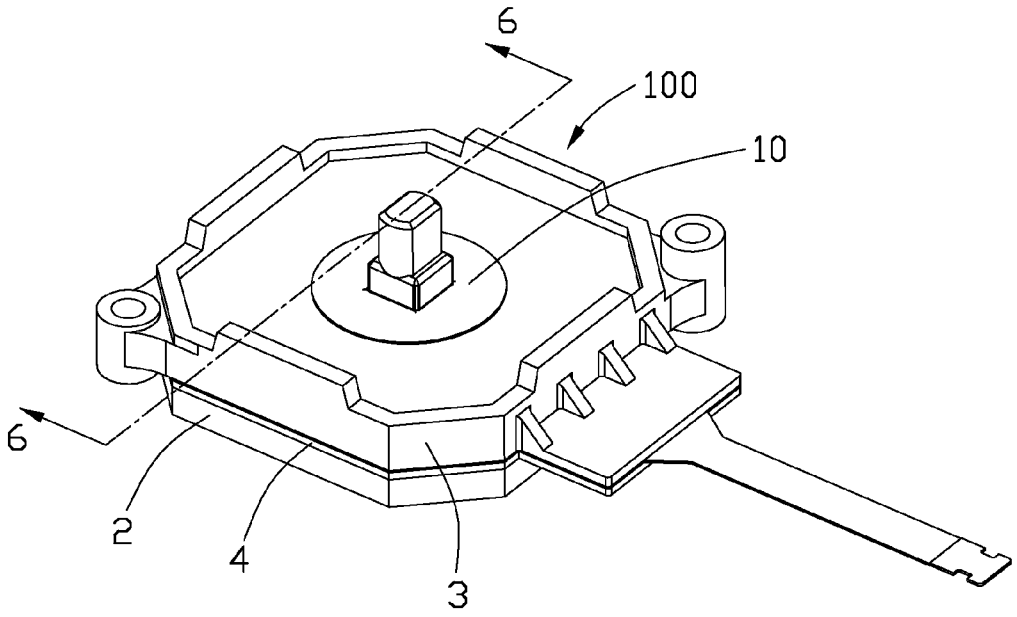
FIG. 1 is a perspective, assembled view of a multi direction switch constructed in accordance with the present invention.
Figure 2:
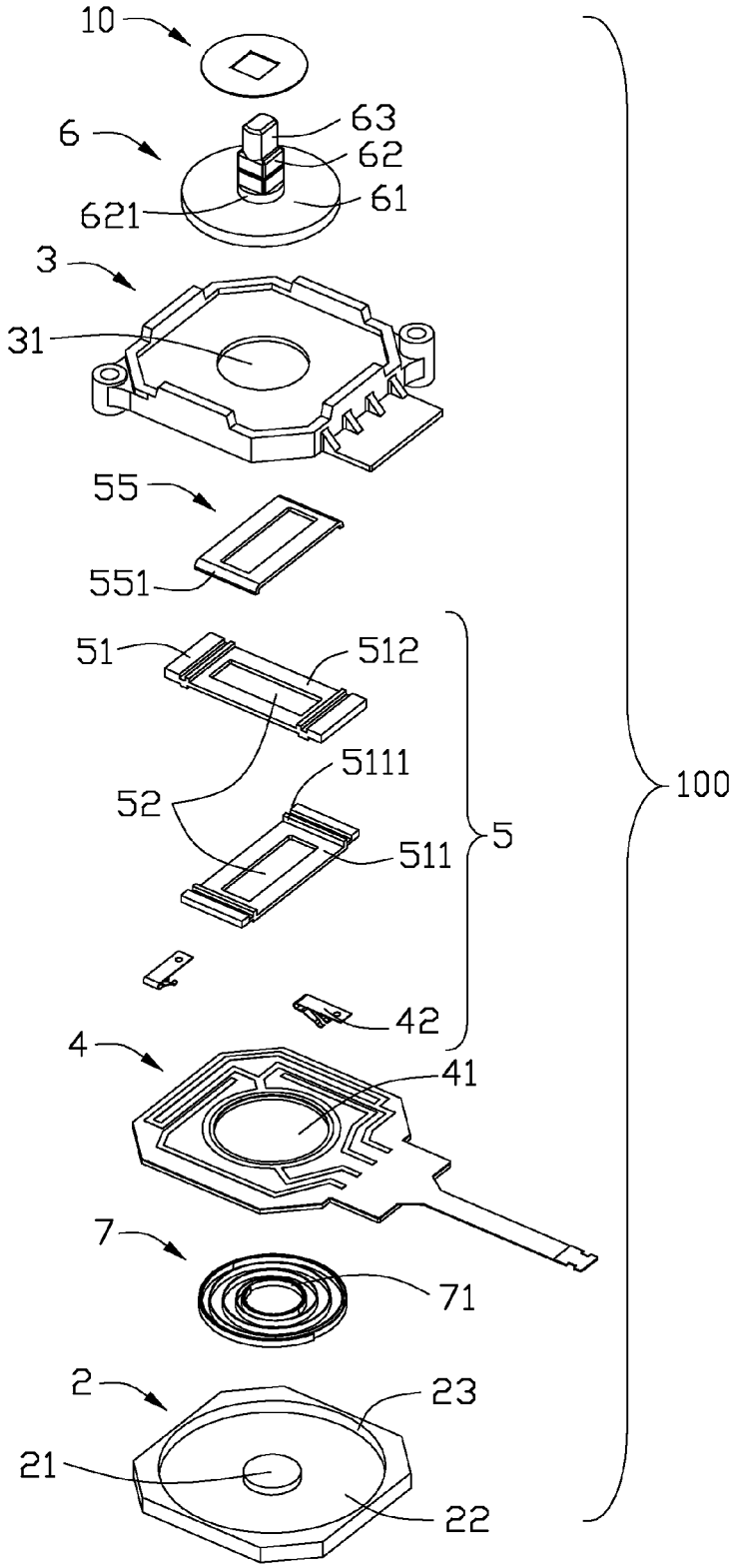
FIG. 2 is a perspective, exploded view of the multi direction switch.
Figure 3:
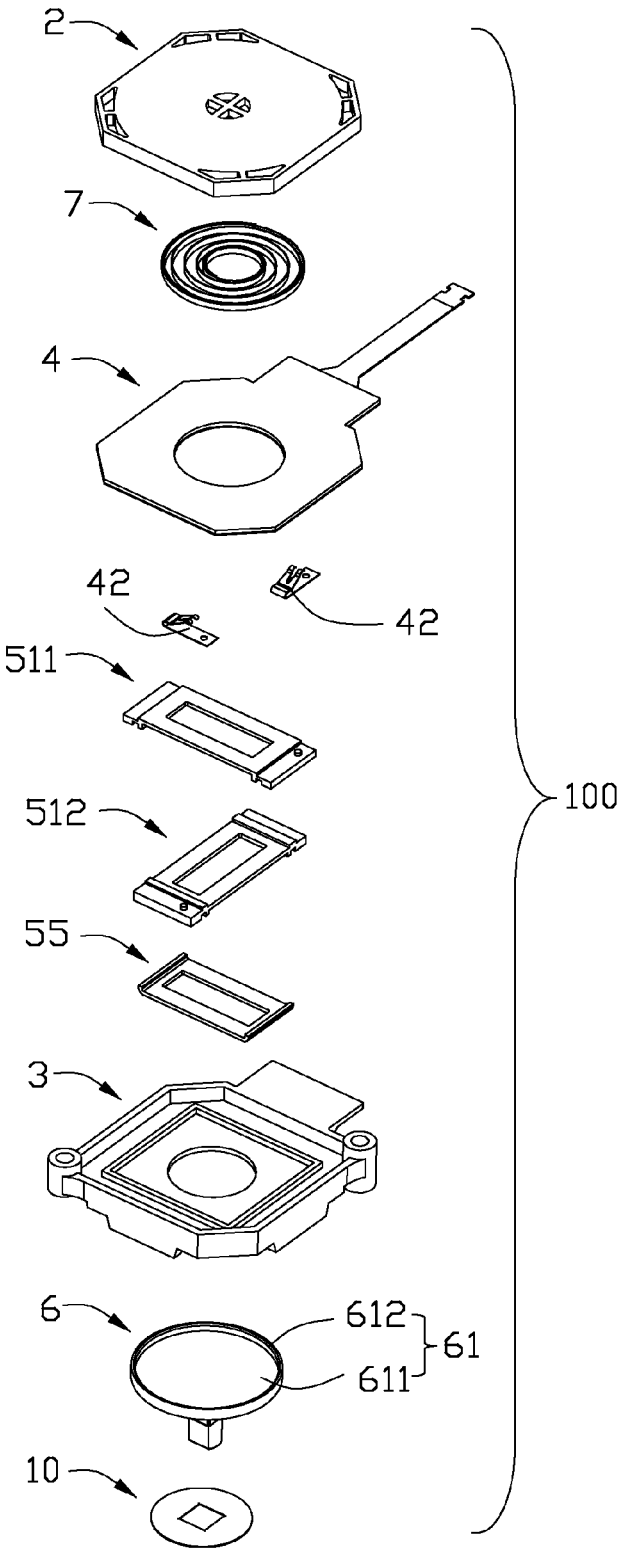
FIG. 3 is another perspective, exploded view of the multi direction switch.

Referring to FIGS. 1-3, a multi direction switch 100 used for denoting multi positions of an electronic appliance (not shown), at which the multi direction switch 100 is assembled in accordance with the present invention, comprises a first bottom cover 2, a second top cover 3, a flexible printed circuit or printed circuit board (PCB) 4 positioned between the bottom cover 2 and the top cover 3, a pair of stacked, orthogonal electrode plates 5, a button 6 actuating the electrode plates 5 to move on the PCB 4 for transferring different signals and denoting multi positions, and a discoid spring member 7 actuating the button 6 to return to its initial position.

Figure 4:
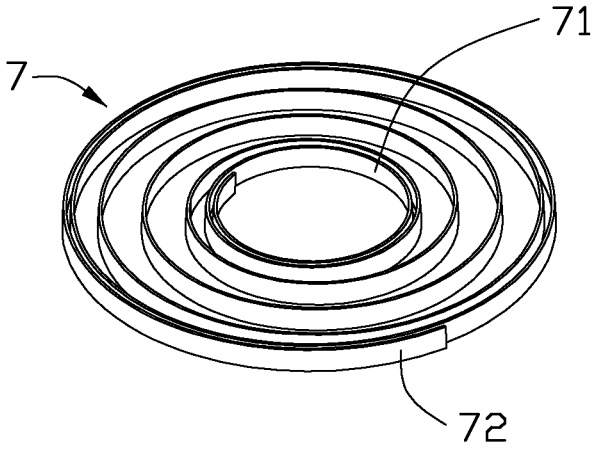
FIG. 4 is a perspective view of a spring member which actuates a pair of electrode plates to return to their initial positions.
Figure 5:
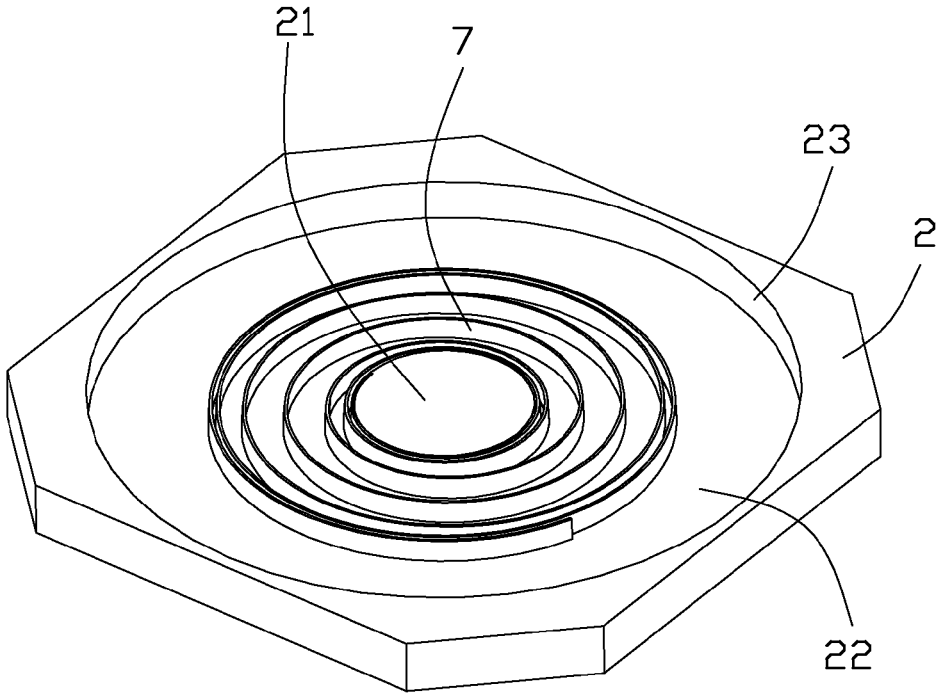
FIG. 5 is a perspective, assembled view of the spring member in a bottom cover of the multi direction switch.
Figure 6:
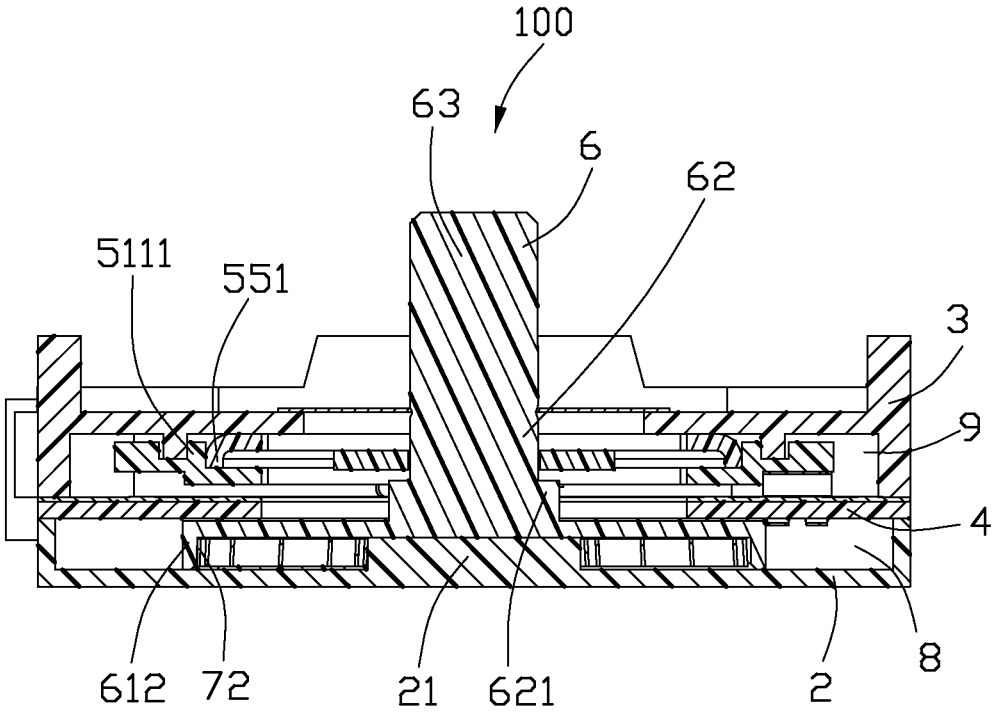
FIG. 6 is cross-sectional view taken along line 6-6 of FIG. 1.

Referring to FIG. 6, a first, lower cavity 8 is defined between the bottom cover 2 and the PCB 4 and a second, upper cavity 9 is defined between the top cover 3 and the PCB 4. Referring to FIGS. 2 and 3, the top cover 3 has a cutout 31 communicating internal and external of the multi direction switch 100 and the bottom cover 2 forms a protrusion 21 towards the PCB 4. Referring to FIGS. 4 and 5, the spring member 7 is circled as a plurality of large-and-small rings and has an internal margin 71 and an external margin 72. The protrusion 21 is protruded into the spring member 7 and connected with the internal margin 71 for orienting the spring member 7. The PCB 4 has a through hole 41 corresponding to the cutout 31 of the top cover 3. The protrusion 21 of the bottom cover 2 is just located below the cutout 31 and the through hole 41.

Referring to FIGS. 2, 3, 5 and 6, the button 6 extend along a vertical direction and comprises a large-dimensioned disc portion 61, an operation portion 63 extending out of the top cover 3 through the cutout 31, and an actuating portion 62 connecting between the large-dimensioned disc portion 61 and the operation portion 63. The actuating portion 62 has a diameter smaller than that of the disc portion 61. The disc portion 61 is positioned in the lower cavity 8 and the actuating portion 62 is positioned in the upper cavity 9. The disc portion 61 comprises a radial portion 611 and a wall portion 612 extending vertically from outer edges of the radial portion. The radial portion 611 extends along a plane direction perpendicular to the vertical direction. The wall portion 612 connects with the external margin 72 for confining the spring member 7. Overall, the spring member 7 is sandwiched between the protrusion 21 of the bottom cover 2 and the wall portion 612 of the button 6. Therefore, the spring member 7 is compressed by the wall portion 612 to have elasticity when the button 6 is operated and moves along multi directions.

Referring to FIGS. 2, 3, and 6, each electrode plate 5 comprises a slider 51 and a contact 42 attached to the slider 51 for moveably connecting with the PCB 4. Each slider 51 defines an elongated slot 52. The actuating portion 62 of the button 6 is received in the elongated slots 52 for actuating the electrode plates 5 to move towards multi directions. The sliders 51 comprise a first, lower slider 511 and a second, upper slider 512. The upper slider 512 is orthogonally stacked on the lower slider 511. The actuating portion 62 forms a stepped portion 621. The lower slider 511 is supported on the stepped portion 621.

Referring to FIGS. 2, 3, and 6, the multi direction switch 100 further comprises a retaining plate 55 located in the upper cavity 9. The retaining plate 55 is positioned above the upper slider 512 and below the top cover 3. The lower slider 511 has a plurality of ribs 5111 at two ends thereof. The retaining plate 55 has a pair of wing portions 551 extending downwardly and engaging with the ribs 5111. The upper slider 512 is positioned between the retaining plate 55 and the lower slider 511 along the vertical direction. The retaining plate 55 cooperates with a bottom of the top cover 3 to restrict a rotational movement of the button 6. The upper slider 512 also is prevented from disengaging away from the lower slider 511 along the vertical direction under restriction of the retaining plate 511. Since the two electrode plates 5 interact with the PCB 4 to function in a conventional, known manner, their details are omitted for simplicity.

Referring to FIGS. 1 and 2, the multi direction switch 100 further comprises a dustproof cover 10 located above the top cover 3. The dustproof cover 10 is used for partly shielding the cutout 31 of the top cover 3 and preventing dust or others from entering into the multi direction switch 100 from the cutout 31. The dustproof cover 10 is jacketed on the button 6 and moves along with the button 6 when the multi direction switch 100 is in use.

Because the spring member 7 of the present invention is sandwiched between the protrusion 21 of the bottom cover 2 and the wall portion 612 of the button 6 along the plane direction, i.e., the spring member 7 is just simply oriented by two components (the bottom cover 2 and the button 6) of the multi direction switch 100, the multi direction switch 100 has a simple structure and is easily assembled.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A multi-direction switch comprising:

opposite first and second covers defining a receiving cavity there between;

a printed circuit board (PCB), a coil spring member and a pair of intersected electrode plates commonly received in the receiving cavity at different levels along an axial direction; and a button linked at an intersected position of the electrode plates to horizontally move the electrode plates on the PCB for electrical transmission consideration, and essentially constantly engaging the spring for mechanical restoration consideration; wherein said button includes a wall portion surrounding the coil spring member so as to horizontally urge the coil spring inside to be compressed when the button is horizontally moved; wherein the button includes an operation portion exposed to an exterior for manual operation, and the operation portion is closer to the electrode plate than to the spring; wherein the printed circuit board defines a through hole below which the wall portion extends.

* * * * *